United States Patent [19]

Berger et al.

[11] Patent Number: 4,723,708

[45] Date of Patent: Feb. 9, 1988

[54] CENTRAL BOLT ULTRASONIC ATOMIZER

[75] Inventors: Harvey L. Berger, Poughkeepsie; Alan Paul, Port Jervis; William J. Broe, Stanfordville, all of N.Y.

[73] Assignee: Sono-Tek Corporation, Poughkeepsie, N.Y.

[21] Appl. No.: 68,717

[22] Filed: Jul. 1, 1987

Related U.S. Application Data

[63] Continuation of Ser. No. 861,512, May 9, 1986, abandoned.

[51] Int. Cl.[4] ..... B05B 3/14

[52] U.S. Cl. ..... 239/102.2; 239/600

[58] Field of Search ..... 239/102.2, 4, 600; 310/325

[56] References Cited

U.S. PATENT DOCUMENTS

| | | | |
|---|---|---|---|
| 3,283,182 | 11/1966 | Jones et al. | 310/8.7 |
| 3,317,139 | 5/1967 | Freeland | 239/102 |
| 3,368,085 | 2/1968 | McMaster et al. | 310/8.3 |
| 3,396,285 | 8/1968 | Minchenko | 310/8.7 |
| 3,689,783 | 9/1972 | Williams | 310/8.3 |
| 3,694,675 | 9/1972 | Loveday | 310/8.9 |
| 3,861,852 | 1/1975 | Berger | 431/1 |
| 4,193,009 | 3/1980 | Durley, III | 310/325 |
| 4,337,896 | 7/1982 | Berger et al. | 239/102 |
| 4,352,459 | 10/1982 | Berger et al. | 239/102 |
| 4,469,974 | 9/1984 | Speranza | 310/325 |
| 4,496,101 | 1/1985 | Northman | 239/102 |
| 4,541,564 | 9/1985 | Berger et al. | 239/102 |

*Primary Examiner*—Andres Kashnikow
*Assistant Examiner*—Michael J. Forman
*Attorney, Agent, or Firm*—Kenyon & Kenyon

[57] ABSTRACT

An ultrasonic atomizing transducer assembly includes cylindrical front atomizing and rear dummy sections clamped to a sandwich of an annular electrode between two annular piezoelectric disks by a central tubular bolt. Liquid to be atomized enters the rear of the transducer assembly through a feed tube forming a rearward extension of the central bolt and flows through an axial passage to exit onto an atomizing surface on the tip of an amplifying probe extending from the front end of the front cylindrical section. An annular sealing member disposed between a sealing surface at the front end of the bolt and the passage prevents liquid flowing through the passage from contacting the inner surfaces of the piezoelectric disks. To protect the outer surfaces of the piezoelectric disks, an enclosed shell surrounds and supports the transducer via O-rings loaded purely in radial compression.

6 Claims, 2 Drawing Figures

CENTRAL BOLT ULTRASONIC ATOMIZER

This application is a continuation of application Ser. No. 861,512, filed May 9, 1986 now abandoned.

BACKGROUND OF THE INVENTION

1. Technical Field

The present invention relates to piezoelectric ultrasonic atomizers, particularly of the type having an atomizing surface at a tip of a reduced diameter amplifying probe at one end of a transducer and a coaxial fluid delivery channel extending from the other end of the transducer to the atomizing surface.

2. Background Art

Piezoelectric ultrasonic atomizers are finding increasing use in industrial applications where liquid materials must be delivered in the form of a very fine spray or mist. The design and construction of such atomizers is described in U.S. Pat. No. 4,337,896 of Berger et al. A typical arrangement is to sandwich a flat electrode between two disks of piezoelectric material, such as lead zirconate titanate, to form a driving element, and then to clamp the driving element between a cylindrical front amplifying horn and a cylindrical rear dummy section. The amplifying horn is provided with a reduced diameter probe having an atomizing surface at its tip. The amplification of vibrational amplitude obtained at the atomizing surface is approximately equal to the ratio between the respective cross-sectional areas of the cylindrical portion of the front horn and of the end of the probe.

In the type of atomizer shown in U.S. Pat. No. 4,337,896, the necessary clamping pressure on the driving element is obtained by providing circumferential flanges on the adjacent ends of the front and rear sections and drawing the flanges together with a circle of bolts. The flanges also provide an annular bearing area for compressing an elastomeric gasket ring, to prevent liquid spray from contacting the outer peripheries of the piezoelectric disks. The sealing effectiveness of such a gasket is an important factor in extending the operating life of the atomizer.

The clamping flange design has drawbacks, however. To reduce internal losses, the front and rear horns should each be made as a single piece. It is wasteful to have to start with stock having an outer diameter equal to the flange diameter and then machine as much as two-thirds of it away. More importantly, the size of droplets formed by an ultrasonic atomizer varies inversely with the frequency of the unit. To obtain very small particles in the micron range, it is necessary to use very high frequencies, well over 100 kHz. To avoid significant transverse wave motion in the transducer, however, the transverse dimensions of the front and rear sections should be less than one-quarter wavelength.

As an example, in titanium a quarter wavelength at frequencies about 100 kHz is less than one centimeter. It is desirable to have the ratio between cylindrical section diameter and probe tip diameter be as large as possible, for increased amplification. At the same time, the atomizing surface should be large enough to handle a reasonable flow and the probe must be sturdy enough to resist breaking in operation. These factors make it undesirable to use up part of the diametral dimensions for clamping flanges.

An alternative arrangement for clamping a cylindrical atomizing transducer and concurrently protecting the piezoelectric elements from liquid contamination is disclosed in U.S. Pat. No. 3,861,852 of Berger. In this arrangement, a cylindrical transducer is inserted into a cup, and the transducer elements are clamped together by force exerted upon a flange on the rear dummy section by a cap threaded into the cup, with the front face of the transducer bearing against the base of the cup. O-rings at the clamping surfaces seal the transducer inside the cup from liquid spray delivered from the tip of a probe extending through an opening in the base of the cup. It is difficult to apply and maintain the proper clamping pressure on the piezoelectric driving element with this arrangement, however, and the end clamping can introduce significant damping and thereby reduce efficiency of the transducer.

Although liquid is fed to the above-described atomizers through a radial passage that intersects an axial channel in the front horn of the transducer, it is also known, for example from U.S. Pat. No. 4,352,459 of Berger et al., to feed the liquid axially through the rear section of a flange-clamped transducer. It is necessary in this design, however, to provide an annular sealing gasket between the feed tube and the inner circumferences of the piezoelectric disks, thus reducing the potential cross sectional area of the disks and thereby the available vibrational driving power. It is also known to clamp the driving element of a piezoelectric transducer by means of a solid central bolt, as in U.S. Pat. Nos. 3,368,085 of McMaster et al.; 3,396,285 of Minchenko, 3,689,783 of Williams, and 3,694,675 of Loveday. The transducers of these patents are not fluid feed atomizers, however.

SUMMARY OF THE INVENTION

It is an object of the present invention to provide a piezoelectric atomizer design having a maximum practical amplification and adapted for high frequency operation above 100 kHz.

It is another object of the present invention to provide an axial feed piezoelectric atomizer that provides effective internal sealing without reducing the cross-sectional area available for the piezoelectric elements.

Another object of the invention is to provide external sealing of the piezoelectric elements in an atomizer as characterized above without axially loading the transducer element.

The above and other objects are achieved in an ultrasonic liquid atomizing transducer assembly comprising a driving element including a pair of annular piezoelectric disks and an annular electrode coaxially positioned therebetween;

terminal means for feeding ultrasonic frequency electrical energy to said electrode;

a cylindrical rear dummy section having a front end contacting one piezoelectric disk of the driving element and a rear end;

a front section having a cylindrical portion, the cylindrical portion having a rear end contacting the other piezoelectric disk of the driving element and a front end, and an amplifying portion extending from the front end of the cylindrical portion, the amplifying portion comprising a probe having a tip that forms an atomizing surface, an axial passage being provided through the length of the transducer from the rear end of the rear dummy section to the atomizing surface and a portion of the passage adjacent the driving element in at least one of the front section and the rear dummy section being enlarged and internally threaded; and a tubular central bolt having external threads engaging said internally threaded portion of the passage and connecting the front section and the rear dummy section under tension to provide a determined compressive preload on the driving element.

The enlarged internally threaded portion of the passage in the atomizing transducer assembly preferably extends into both the front section and the rear section, and the central bolt comprises a threaded stud engaging the internally threaded portion in both the front and rear sections, the threaded stud having a front end formed with a smooth sealing surface, and the assembly further includes an annular sealing means disposed between said sealing surface and the axial passage to prevent liquid flowing in the passage from reaching the inner surface of the piezoelectric disks.

To prevent liquid contact with the outer surfaces of the piezoelectric disks, the assembly may further comprise an enclosed shell surrounding the transducer assembly, the shell having a front end wall provided with an opening that slidably receives the cylindrical portion of the front section and a radially compressed annular sealing means disposed between the opening and the circumference of the cylindrical portion of the front section. The shell further has a rear wall that may be provided with an opening that slidably receives an axial feed tube extending from the rear end of the rear dummy section and a radially compressed annular sealing means disposed between the opening and the feed tube.

The above and other objects, features and advantages of the present invention will be more readily apparent from the following description of the preferred embodiments when considered with the accompanying drawings and the appended claims.

BRIEF DESCRIPTION OF THE DRAWINGS

The present invention is illustrated by way of example and not limitation in the FIGS. of the accompanying drawing in which like numerals indicate the same or similar part and in which.

DESCRIPTION OF THE PREFERRED EMBODIMENT

Figure 1:
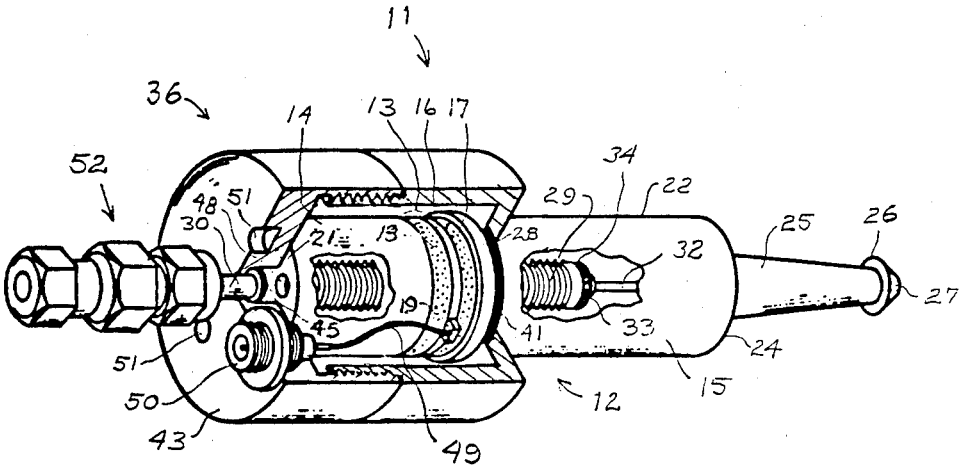
FIG. 1 is a partially cut away perspective view of an ultrasonic atomizing transducer assembly according to the invention.
Figure 2:
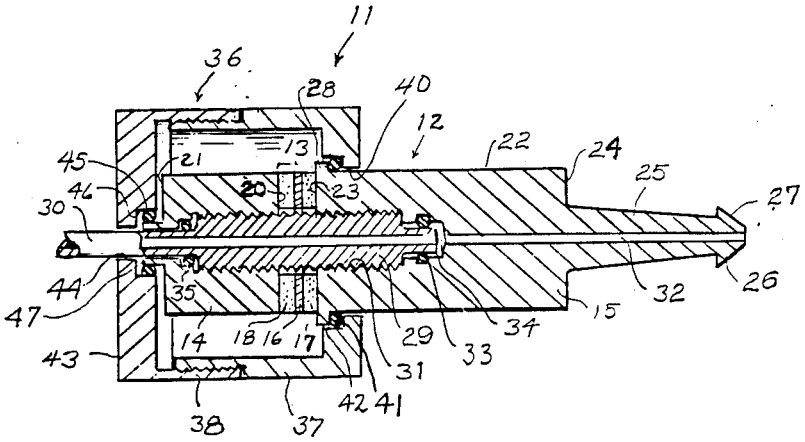
FIG. 2 is a view in longitudinal cross-section of the transducer assembly of FIG. 1.

With reference to the figures, a currently preferred embodiment of an ultrasonic atomizing transducer assembly 11 includes a transducer 12 having a driving element 13, a rear dummy section 14, and a front atomizing section 15.

The driving element 13 is assembled from a washer-shaped metal electrode 16 sandwiched between a pair of annular piezoelectric disks 17 and 18. The electrode may be made of copper or any other suitable metal having high electrical conductivity, and it is provided with a terminal 19 for attachment to a source of electrical energy at the resonant frequency of the transducer. The piezoelectric disks are made of any material conventionally used for such service, such as barium titanate or lead zirconate titanate.

The rear dummy section 14 is a metal cylinder, preferably titanium, having a length equal to a quarter wavelength at the designed operating frequency of the transducer. A front end 20 of the rear section 14 contacts the rear piezoelectric disk 18, and a rear end 21 of the rear section is free to vibrate as an antinodal plane. The front atomizing section 15 includes a cylindrical portion 22 having a rear end 23 that contacts the front piezoelectric disk 17 and a front end 24 that lies in a nodal plane, the cylindrical portion 22 being designed to be one-half wavelength long at the operating frequency of the transducer. From the front end of the cylindrical portion 22, a quarter wavelength amplifying probe 25 extends to a frustoconical tip 26 having an atomizing surface 27. The front atomizing section preferably is made of the same material as the rear dummy section, although a different material could be used if desired, so long as the appropriate wavelength dimensions were used to match the operating frequency of the rear section.

Except for a narrow circumferential flange 28 at the rear end of the front section, the outer diameter of the transducer is equal to the diameters of the front and rear sections. These sections are clamped against the driving element 13 with a predetermined compressive stress by a central tubular bolt 29 that is formed as an enlarged threaded stud on the end of a liquid feed tube 30. The tubular bolt engages an internally threaded enlarged portion 31 of an axial passage 32 that extends through the transducer from the rear end of the rear dummy section 14 to open onto the atomizing surface 27 at the tip of the probe 25.

To prevent liquid flowing through the delivery tube 30 into the passage 32 from penetrating past the threaded portion of the front section and contacting the internal surfaces of the piezoelectric disks, an O-ring seal 33 is provided between a smooth sealing surface 34 machined on the front end of the central bolt 29 and the inner surface of the passage 32. As illustrated, the O-ring is fitted into a circumferential groove machined into the wall of the passage to assure that the O-ring is properly located with respect to the sealing surface 34. The groove could equally well be formed on the end of the bolt, or any other conventional sealing arrangement could be used between the end of the bolt and the inner surface of the passage in the front section.

An additional O-ring 35 is provided to seal between the outer circumference of the feed tube 30 and the inner circumference of the axial passage. This second O-ring prevents ingress of moisture from the environment surrounding the atomizer.

Because there are no clamping flanges on the transducer body to provide an annular area for a compressed ring gasket around the outside of the driving element, the outer peripheries of the piezoelectric disks are protected by an enclosed shell 36. This shell is in the form of a cylindrical cup 37 having a screw cap 38. The cup 37 has an end wall 39 provided with an opening 40 which receives the cylindrical portion 22 of the front section of the transducer. This opening is sealed by a radially compressed O-ring 41 disposed between the outer circumference of the cylindrical portion 22 and a counterbore 42 in the opening 40. The screw cap 38 has an end wall 43 with a similar but smaller opening 44. An O-ring 45 in a counterbore 46 seals this opening in the same way as O-ring 41 seals the front opening. As illustrated, O-ring 45 is radially compressed between the counterbore 46 and a cylindrical collar 47 extending from the end 21 of the rear dummy section.

Alternatively, the dimensions of the collar and the counterbore could be revised so that the O-ring 45 could seal radially against the outer periphery of the feed tube 30 and abut against the end of the collar. It is important, however, that there be no axial compression force exerted by the shell against the transducer body via the O-rings 41 and 45. In this connection, the narrow flange 28 at the rear of the front section serves merely to lcoate the O-ring 41 as close as possible to the nodal plane defined by the electrode 16. There should be no axial force exerted against this flange by the O-ring since the O-ring 45 at the rear of the shell has room to float axially. Consequently, the transducer is supported in the shell substantially purely radially, with no axial force exerted between the shell and the transducer.

The procedure for assembling the transducer is as follows. After the O-ring 33 is installed into its groove in the front section 22, the central bolt is screwed into the front section until it bottoms. The piezoelectric disks and the center electrode are then passed over the bolt. If desired, a sleeve of electrical insulating material (not shown) may be inserted between the bolt and the inner circumferences of the disks and electrode. This will help to center the driving element as well as to prevent a short circuit of the driving element. It also may be desirable to add a second annular electrode (not shown) between the rear piezoelectric disk and the rear dummy section to provide a second terminal to facilitate completing the electrical circuit across the piezoelectric disks.

After the driving element is assembled onto the bolt, the O-ring 35 is fitted over the feed tube 30, and the rear dummy section is then screwed down against the driving element. The proper compression force is obtained by applying a torque wrench to two diametrically spaced detent holes 48 drilled in the rear end 21 of the rear dummy section.

Following assembly of the transducer, the shell can be mounted by first installing O-ring 45 on the collar 47 (or on the tube 30 in the above-mentioned alternative arrangement) and then sliding the threaded cap 38 over the tube 30 into place over the rear dummy section. A lead wire 49 attached to a hermetically sealed coaxial fitting 50 mounted on the end wall of the cap is then clipped or soldered to terminal 19 of the center electrode 16. If a second electrode is provided, as described above, a second lead wire (not shown) from a second coaxial fitting (not shown) should be similarly attached to the second electrode. Finally, the O-ring 41 is placed on the cylindrical portion 22 of the front atomizing section, and the cup 37 is slipped onto the cylindrical section 22 and screwed into the cap 38 until it bottoms. The cap can be tightened by means of a spanner wrench fitting the detent holes 51 in the end wall of the cap.

Since the transducer is connected to the shell only radially through the "axially floating" O-rings 41 and 45, the transducer can be mounted by clamping or fastening to the shell in any desired way without adversely affecting either the compression preload on the driving element 13 or the resonant frequency of the transducer. Liquid can be delivered to the rear of the unit via a flexible hose (not shown) connected to the delivery tube 30 by the standard coupling connectors 52 (see FIG. 1). Alternatively, the assembly can be supported by a rigid liquid supply pipe coupled to the delivery tube 30.

To test the above-described design, an atomizing transducer was built and tested. The dimensions were chosen for an operating frequency of about 56 kHz. The front and rear transducer sections were made of titanium and the central bolt was made of 316 stainless steel, to provide corrosion resistance for a wide variety of operating liquids. Due to the relatively low yield strength of this material, however, it is a marginal choice particularly for higher frequencies, because the bolt may have to be torqued beyond its yield point to obtain the required compression on the piezoelectric disks. Thus, in applications where corrosion resistance is not a prime consideration, it may be preferable to use a stronger steel for the central bolt material.

In testing the completed assembly, it was found to be essential to avoid any axial loading on the O-rings of the shell; otherwise, the electrical impedance of the unit would vary over a wide range with time, making it impossible to maintain operation at peak efficiency. With purely radial compression of the O-rings, however, stable operation and repeatable results were easily obtained. The shell was leak-free even when the unit was operated submerged under water.

Accordingly, the design of the present invention is adapted to provide an ultrasonic atomizing transducer that is simple to manufacture and is completely shielded from damp or hazardous environments, such as explosive atmospheres. By eliminating the clamping flanges of prior designs, it is possible to obtain a high amplification factor without having the transverse dimensions of the transducer body exceed the practical limit for achieving substantially one-dimensional vibration.

Certain changes and modifications of the disclosed embodiment will be readily apparent to those skilled in the art. For example, the central bolt could be integrally formed as part of the rear or front section in applications where the material of the section is strong enough to carry the necessary tensile stress for preloading the piezoelectric disks. In addition, it is possible to provide many different sealing arrangements within the prescribed limitations. It is the applicants' intention, therefore, to claim all those changes and modifications which could be made to the disclosed embodiment without departing from the spirit and scope of the invention.

We claim:

1. An ultrasonic liquid atomizing transducer assembly comprising:

a driving element including a pair of annular piezoelectric disks and an annular electrode coaxially positioned therebetween;

terminal means for feeding ultrasonic frequency electrical energy to said electrode;

a cylindrical rear dummy section having a front end contacting one piezoelectric disk of the driving element, a rear end, and a constant outside diameter from the front end to the rear end;

a front section having a cylindrical portion, the cylindrical portion having a rear end contacting the other piezoelectric disk of the driving element and a front end, and an amplifying portion extending from the front end of the cylindrical portion, the amplifying portion comprising a probe having a tip that forms an atomizing surface, an axial passage being provided through the length of the transducer assembly from the rear end of the rear dummy section to the atomizing surface, and a portion of the passage adjacent the driving element in both the front atomizing section and the rear dummy section being enlarged and internally threaded;

a tubular central bolt having an externally threaded portion engaging said internally threaded portion of the passage in both the front atomizing section and the rear dummy section with sufficient torque to connect the front atomizing section and the rear dummy section under a tension that provides all of a predetermined total compressive preload on the driving element, the externally threaded portion extending from a front end portion of the bolt located in the front atomizing section and formed with a smooth cylindrical sealing surface to a rear feed tube portion of the bolt located in the rear dummy section and extending axially beyond the rear end of the dummy section; and means for sealing the piezoelectric disks from contact with the liquid being atomized, said means comprising a resilient annular sealing member disposed between said sealing surface and the axial passage in the front section to prevent liquid flowing in the pasasge from reaching the inner circumferential surfaces of the piezoelectric disks.

2. An atomizing transducer assembly according to claim 1 wherein the annular sealing member comprises an O-ring.

3. An atomizing transducer assembly according to claim 1 wherein the means for sealing the piezoelectric disks comprises an additional annular sealing member disposed between the smooth exterior surface of said liquid feed tube and the axial passage to prevent moisture in the environment surrounding the transducer assembly from reaching the inner circumferential surfaces of the piezoelectric disks.

4. An atomizing transducer assembly according to claim 3 wherein the additional annular sealing member comprises an O-ring.

5. An atomizing transducer assembly comprising:

a driving element including a pair of annular piezoelectric disks and an annular electrode coaxially positioned therebetween;

terminal means for feeding ultrasonic frequency electrical energy to said electrode;

a cylindrical rear dummy section having a front face contacting one piezoelectric disk of the driving element, a rear face, the dummy section having a constant outside diameter from the front face to the rear face, and a concentric portion having a smooth cylindrical outer sealing surface of reduced diameter extending from said rear face;

a front section having a cylindrical portion, the cylindrical portion having a rear face contacting the other piezoelectric disk of the driving element and a front face, and an amplifying portion extending from the front face of the cylindrical portion, the amplifying portion comprising a probe having a tip that forms an atomizing surface, an axial passage being provided through the length of the transducer assembly from the rear face of the rear dummy section to the atomizing surface, and a portion of the passage adjacent the driving element in both the front atomizing section and the rear dummy section being enlarged and internally threaded;

a tubular central bolt having an externally threaded portion engaging said internally threaded portion of the passage in both the front atomizing section and the rear dummy section with sufficient torque to connect the front atomizing section and the rear dummy section under a tension that provides all of a predetermined total compressive preload on the driving element, the externally threaded portion extending from a front end portion of the bolt located in the front atomizing section and formed with a smooth cylindrical sealing surface to a rear feed tube portion of the bolt located in the rear dummy section and extending axially beyond the rear end of the dummy section; and means for sealing the piezoelectric disks from contact with the liquid being atomized, said means comprising a resilient first annular sealing member disposed between said sealing surface and the axial passage in the front section, to prevent liquid flowing in the passage from reaching the inner circumferential surfaces of the piezoelectric disks, and an enclosed circular cylindrical shell surrounding the transducer assembly, the cylindrical shell having a front end wall provided with a first cylindrical passage that loosely receives the cylindrical portion of the front section, a rear wall provided with a second cylindrical passage that loosely surrounds the concentric portion extending from the rear face of the dummy section, a resilient second annular sealing means disposed between the inner surface of the first cylindrical passage and the circumference of the cylindrical portion of the front section, and a resilient third annular sealing means disposed between the inner surface of the second cylindrical passage and the outer sealing surface of the concentric portion, the radial spacing between the cylindrical portion of the front section and the first cylindrical passage and the radial spacing between the concentric portion of the rear dummy section and the second cylindrical passage being respectively less than the radial thicknesses of the second and the third annular sealing means when unconstrained, so that the second and third annular sealing means are radially compressed between said passages and said cylindrical and concentric portions, respectively, and wherein said first and second annular sealing means are unconstrained in the axial direction, with no axial pressure exerted thereon.

6. An atomizing transducer assembly according to claim 5 wherein said enclosed shell comprises a cylindrical cup and a cylindrical cap threadedly fitting on said cup.

* * * * *